US009670766B2

(12) United States Patent
Grande et al.

(10) Patent No.: US 9,670,766 B2
(45) Date of Patent: Jun. 6, 2017

(54) METHOD AND SYSTEM FOR RECOVERING AND PROCESSING HYDROCARBON MIXTURE

(71) Applicant: STATOIL CANADA LIMITED, Calgary, Alberta (CA)

(72) Inventors: Knut Vebjørn Grande, Trondheim (NO); Karina Heitnes Hofstad, Ranheim (NO); Harald Vindspoll, Trondheim (NO); Marianne Haugan, Trondheim (NO)

(73) Assignee: STATOIL CANADA LIMITED, Calgary, Alberta (CA)

( * ) Notice: Subject to any disclaimer, the term of this patent is extended or adjusted under 35 U.S.C. 154(b) by 188 days.

(21) Appl. No.: 14/412,879

(22) PCT Filed: Jul. 4, 2013

(86) PCT No.: PCT/EP2013/064198

§ 371 (c)(1),
(2) Date: Jan. 5, 2015

(87) PCT Pub. No.: WO2014/006165

PCT Pub. Date: Jan. 9, 2014

(65) Prior Publication Data

US 2015/0167444 A1 Jun. 18, 2015

(30) Foreign Application Priority Data

Jul. 6, 2012 (GB) ..... 1212075.4

(51) Int. Cl.
*E21B 43/24* (2006.01)
*E21B 43/40* (2006.01)
(Continued)

(52) U.S. Cl.
CPC ..... *E21B 43/40* (2013.01); *C10G 1/002* (2013.01); *C10G 1/047* (2013.01); *C10G 21/003* (2013.01);
(Continued)

(58) Field of Classification Search
CPC ..... E21B 43/40; E21B 36/00; E21B 43/24; E21B 43/2406; C10G 1/002; C10G 1/047; C10G 21/003; C10G 55/04; C10G 21/00
See application file for complete search history.

(56) References Cited

U.S. PATENT DOCUMENTS 4,191,639 A * 3/1980 Audeh ..... B01D 11/0407 208/251 R
5,843,303 A 12/1998 Ganeshan
(Continued)

FOREIGN PATENT DOCUMENTS

FR 2937648 A1 * 4/2010 ..... C01B 3/34
WO WO 2012/090178 A1 7/2012

*Primary Examiner* — Yong-Suk (Philip) Ro
(74) *Attorney, Agent, or Firm* — Birch, Stewart, Kolasch & Birch, LLP

(57) ABSTRACT

A steam-based method and system for recovering and processing a hydrocarbon mixture from a subterranean formation. Steam is injected into the subterranean formation to mobilize said hydrocarbon mixture, then the mobilized hydrocarbon mixture is recovered, a self-sufficient diluent is added, and the mixture is separated to produce separated water and separated hydrocarbon. The separated hydrocarbon is deasphalted to produce a deasphalted hydrocarbon and asphaltenes, which is combusted in an oxycombustion process to generate steam and/or energy and $CO_2$, and said the steam is injected into the formation.

29 Claims, 2 Drawing Sheets

(51) Int. Cl.

| | |
|---|---|
| ***C10G 55/04*** | (2006.01) |
| ***C10G 1/00*** | (2006.01) |
| ***C10G 1/04*** | (2006.01) |
| ***C10G 21/00*** | (2006.01) |
| ***E21B 36/00*** | (2006.01) |

(52) U.S. Cl.
CPC ..... *C10G 55/04* (2013.01); *E21B 36/00* (2013.01); *E21B 43/24* (2013.01); *E21B 43/2406* (2013.01)

(56) References Cited

U.S. PATENT DOCUMENTS

| | | | | |
|---|---|---|---|---|
| 6,054,496 | A | 4/2000 | Crane et al. | |
| 6,357,526 | B1 | 3/2002 | Abdel-Halim et al. | |
| 2006/0042999 | A1 | 3/2006 | Iqbal et al. | |
| 2007/0045155 | A1* | 3/2007 | Selmen | C10G 1/047 208/49 |
| 2008/0289821 | A1 | 11/2008 | Betzer Tsilevich | |
| 2009/0294328 | A1 | 12/2009 | Iqbal | |
| 2010/0155062 | A1* | 6/2010 | Boone | C09K 8/58 166/272.3 |
| 2011/0094937 | A1 | 4/2011 | Subramanian et al. | |
| 2011/0266196 | A1* | 11/2011 | Gauthier | C01B 3/34 208/95 |

* cited by examiner

METHOD AND SYSTEM FOR RECOVERING AND PROCESSING HYDROCARBON MIXTURE

FIELD OF THE INVENTION

The present invention relates to a method of recovering a hydrocarbon mixture, especially a heavy hydrocarbon mixture, from a subterranean formation by a steam-based method and to processing the hydrocarbon mixture to a transportable product. A feature of the present invention is that it is at least partially self-sufficient in terms of steam generation and diluent. Preferred methods are also at least partially self-sufficient in terms of water. The invention further relates to systems for carrying out the method of the invention.

BACKGROUND

Heavy hydrocarbons, e.g. bitumen, represent a huge natural source of the world's total potential reserves of oil. Present estimates place the quantity of heavy hydrocarbon reserves at several trillion barrels, more than 5 times the known amount of the conventional, i.e. non-heavy, hydrocarbon reserves. This is partly because heavy hydrocarbons are generally difficult to recover by conventional recovery processes and thus have not been exploited to the same extent as non-heavy hydrocarbons. Heavy hydrocarbons possess very high viscosities and low API (American Petroleum Institute) gravities which makes them difficult, if not impossible, to pump in their native state. Additionally heavy hydrocarbons are characterised by high levels of unwanted compounds such as asphaltenes, trace metals and sulphur that need to be processed appropriately during recovery and/or refining.

A number of methods have been developed to extract and process heavy hydrocarbon mixtures. The method that is used most often commercially today for heavy hydrocarbon recovery from subterranean reservoirs is steam assisted gravity drainage (SAGD). In this method two horizontal wells are drilled approximately five meters apart then steam is injected into the reservoir through the upper wellbore permeating the oil sand. Steam softens the heavy hydrocarbon (e.g. bitumen) and enables it to flow out of the reservoir and into the lower well. From there it is pumped to the surface facilities. The transportability of the viscous heavy hydrocarbon mixture recovered is conventionally improved by dilution with a lighter hydrocarbon such as naphtha, a very light crude oil or a condensate (i.e. by addition of a diluent). The dilution of the heavy hydrocarbon with the diluent typically increases its overall API to about 20 degrees enabling it to be pumped to a refinery.

Nevertheless the SAGD process still suffers from inherent drawbacks. These include:

(i) the use of natural gas for steam generation causes high $CO_2$ emissions whereas it has already been recognised in the energy industry that $CO_2$ emissions must be managed better;

(ii) diluent is often added to transport the recovered hydrocarbon to refineries therefore large volumes of diluent must be transported and stored at extraction sites; and (iii) higher levels of asphaltenes are present in the recovered hydrocarbon than non-heavy hydrocarbon and it has little commercial value.

There have been a number of attempts in the prior art to alleviate or minimise the above-mentioned disadvantages of conventional SAGD processing. U.S. Pat. No. 6,357,526 and WO2012/090178, for example, disclose processes and systems for producing heavy oil by SAGD wherein asphaltenes are separated from the crude heavy hydrocarbon and are ultimately used to generate steam.

Nevertheless a need still exists for steam-based recovery processes for hydrocarbon mixtures, and especially heavy hydrocarbon mixtures, which are less demanding in terms of steam generation and/or external energy required to recover and process the hydrocarbon. Methods that additionally reduce the need for external processing chemicals such as diluents would naturally be particularly beneficial.

The present inventors have now devised a steam-based method of recovering and processing a hydrocarbon mixture wherein at least some of the steam injected into the formation for hydrocarbon recovery is generated directly or indirectly from oxycombustion of a part of the recovered hydrocarbon mixture and another part of the recovered hydrocarbon mixture is used as a diluent in the processing of the recovered hydrocarbon mixture. The method of the present invention is therefore at least partially self-sufficient in terms of steam and also diluent.

SUMMARY OF INVENTION

Thus viewed from a first aspect the present invention provides a steam-based method of recovering and processing a hydrocarbon mixture from a subterranean formation comprising:

(i) injecting steam into said formation to mobilise said hydrocarbon mixture (ii) recovering said mobilised hydrocarbon mixture, wherein said mobilised hydrocarbon mixture comprises water and hydrocarbon;

(iii) separating said hydrocarbon mixture to produce separated water and separated hydrocarbon, wherein a diluent is added to said mobilised hydrocarbon mixture prior to said separation;

(iv) deasphalting said separated hydrocarbon to produce a deasphalted hydrocarbon and asphaltenes;

(v) combusting said asphaltenes in an oxycombustion process to generate steam and/or energy and $CO_2$; and (vi) injecting said steam produced in step (v) into said formation and/or applying said energy produced in step (v) to generate steam and injecting said steam into said formation, wherein said method is at least partially self-sufficient in terms of steam generation and said method is at least partially self-sufficient in terms of diluent.

Viewed from a further aspect the present invention provides a system for recovering and processing a hydrocarbon mixture comprising:

(a) a means for recovery of said hydrocarbon mixture comprising a well arrangement for a steam-based method of recovering said hydrocarbon mixture comprising a production well;

(b) a separator for separating said recovered hydrocarbon mixture into separated water and separated hydrocarbon, said separator having an inlet fluidly connected to said well arrangement, an outlet for separated hydrocarbon fluidly connected to said fractionator and an outlet for separated water;

(c) a fractionator having an inlet for separated hydrocarbon fluidly connected to said separator, an outlet for a heavier fraction fluidly connected to said deasphalter unit and an outlet for at least one lighter fraction;

(d) a deasphalter unit fluidly connected to said fractionator and having an outlet for deasphalted hydrocarbon and an outlet for asphaltenes;

(e) an oxycombustion unit fluidly connected to said outlet for asphaltenes of said deasphalter and have an outlet for steam and/or a means to store energy for conversion of water into steam; and (f) a means for transporting steam generated by said oxycombustion unit to said well arrangement; and (g) a means for transporting said at least one lighter fraction from said fractionator to said separator and/or to the line transporting recovered hydrocarbon mixture to said separator.

DESCRIPTION OF INVENTION

The methods of the present invention are at least partially self-sufficient or self-supporting. As used herein the terms self-sufficient and self-supporting refer to the fact that the method provides or generates a proportion of its own raw materials and/or energy. The methods of the present invention are at least partially self-sufficient in terms of steam generation. This means that the methods generate steam from a part of the hydrocarbon mixture recovered from the subterranean formation, i.e. some of the steam and/or energy is not generated from externally provided natural gas. The methods of the present invention are also at least partially self-sufficient in terms of diluent for addition to recovered hydrocarbon mixture during separation. Thus preferably the methods generate at least some, more preferably substantially all, e.g. all, of the diluent required for processing from the recovered hydrocarbon mixture. Preferred methods of the invention are also at least partially self-sufficient in terms of water, diluent for addition to deasphalted hydrocarbon and/or solvent for deasphalting.

The methods of the present invention are concerned with the recovery and processing of a hydrocarbon mixture. As used herein, the term "hydrocarbon mixture" is used to refer to a combination of different hydrocarbons, i.e. to a combination of various types of molecules that contain carbon atoms and, in many cases, attached hydrogen atoms. A "hydrocarbon mixture" may comprise a large number of different molecules having a wide range of molecular weights. Generally at least 90% by weight of the hydrocarbon mixture consists of carbon and hydrogen atoms. Up to 10% by weight may be present as sulphur, nitrogen and oxygen as well as metals such as iron, nickel and vanadium (i.e. as measured sulphur, nitrogen, oxygen or metals). These are generally present in the form of impurities of the desired hydrocarbon mixture.

The methods of the present invention are particularly useful in the recovery and processing of heavy hydrocarbon mixtures. A heavy hydrocarbon mixture comprises a greater proportion of hydrocarbons having a higher molecular weight than a relatively lighter hydrocarbon mixture. Terms such as "light", "lighter", "heavier" etc. are to be interpreted herein relative to "heavy".

As used herein a heavy hydrocarbon mixture preferably has an API gravity of less than about 20°, preferably less than about 15°, more preferably less than 12°, still more preferably less than 10°, e.g. less than 8°. It is particularly preferred if the API gravity of the heavy hydrocarbon mixture recovered and processed by the method of the present invention is from about 5° to about 15°, more preferably from about 6° to about 12°, still more preferably about 7° to about 12°, e.g. about 7.5-9°. At such API gravities, viscosity and flowability are matters of concern.

The viscosity of a heavy hydrocarbon mixture may be as high as 1,000,000 cP at formation temperature and pressure. Heavy hydrocarbon mixtures having these API gravities and/or viscosities tend to comprise significant amounts of aromatic and naphthalenic compounds, as well as sulphur compounds, making hydrocarbon recovery and processing particularly problematic.

Examples of heavy hydrocarbon mixtures that typically have API gravities and/or viscosities falling in the above-mentioned ranges are bitumens, tars, oil shales and oil sand deposits.

The crude hydrocarbon mixture, e.g. heavy hydrocarbon, recovered and processed by the method of the present invention may be obtained using any steam-based recovery technique. Representative examples of steam-based techniques that may be used to recover heavy hydrocarbon mixtures include steam assisted gravity drainage (SAGD), hot solvent extraction, VAPEX, cyclic steam stimulation (CSS) and combinations thereof. The method of the present invention is, however, particularly useful when SAGD is the recovery method.

In SAGD two horizontal wells, typically referred to as an injection well and a producer well, are drilled into the reservoir, vertically separated by, e.g. 5-10 meters. This group of two wells is typically referred to as a well pair or a SAGD well pair. Steam is injected into the upper injection well, flows outward, contacts the hydrocarbon above it, condenses and transfers its latent heat to the hydrocarbon. This heating reduces the viscosity of the hydrocarbon, its mobility increases and it flows due to gravity to the lower producer well from where it can be produced.

Thus in the methods of the present invention the steam-based method of recovering a hydrocarbon mixture is preferably SAGD. Preferably the step of injecting steam into the formation to mobilise the hydrocarbon mixture is carried out by injecting steam into the injection well of a SAGD well pair. Preferably the step of recovering the mobilised hydrocarbon mixture is carried out by pumping it from the producer well of a SAGD well pair. SAGD is preferably carried out using conventional equipment and under conventional conditions.

The mobilised hydrocarbon mixture recovered at the surface by steam based methods, e.g. SAGD, is typically in the form of a mixture with water from condensed steam and formation water. Prior to carrying out the deasphalting step of the method of the present invention a diluent is added to the hydrocarbon mixture recovered from a formation. Diluent addition is advantageous if, e.g. the crude heavy hydrocarbon mixture is unstable. Diluent addition is also used to adjust the API of the crude hydrocarbon mixture into a range in which crude hydrocarbon and water can be easily separated. Diluent addition may, for example, be carried out to adjust the API of the crude hydrocarbon mixture to about 15-20°. Diluent is added to the mobilised hydrocarbon mixture prior to the separation.

The diluent added to the crude hydrocarbon mixture is from a part of the hydrocarbon mixture recovered from the subterranean formation. The diluent added to the crude hydrocarbon mixture is preferably a diluent, e.g. comprising naptha, kerosene and/or light gas oils, obtained by fractionating the hydrocarbon mixture. This is discussed below in more detail. In this sense the method of the present invention is at least partially self-sufficient or self-supporting in terms of diluent. This reduces or avoids the need to transport and store external diluent on site for this purpose.

The methods of the invention comprise the step of separating the hydrocarbon mixture to produce separated water and separated hydrocarbon. A bulk separator may be used to carry out the bulk separation on the hydrocarbon and water mixture. Different types of separator are available, e.g. a gravity separator, a cyclone separator or a vortex separator. Preferably, however, the separator is a gravity separator. The separator optionally includes means for separation of gas from the mixture. The separator optionally includes means for separation of solids from the mixture.

In the bulk separator the hydrocarbon and water mixture is separated to yield separated hydrocarbon and separated water. The mixture is fed into the bulk separator and allowed, for example, to separate out to a gas phase, a hydrocarbon phase, a water phase and a solids phase in vertically descending order. Optionally chemicals such as emulsion breakers may be added to the separator to improve the separation. Optionally further diluent is added to the separated hydrocarbon after separation.

The separated water predominantly comprises water but generally also contains impurities such as hydrocarbon and dissolved organics and inorganics. Preferably the separated water is cleaned and recycled for use in steam generation. Particularly preferably the separated water is converted to steam using energy generated in the oxycombustion. Preferably the steam generated is reinjected into a formation. Preferred methods are at least partially self-sufficient in terms of water for steam generation.

Conventional methods may be used to clean the water to the necessary level for entry into steam generators. An advantage of the method of the invention is therefore that water can be recycled and hence the amount of fresh water required is minimised. In this sense the preferred methods of the present invention are self-sufficient or self-supporting in terms of water.

The separated hydrocarbon predominantly comprises hydrocarbon. As explained above, this hydrocarbon is a mixture of different hydrocarbons. Preferably at least 75% by volume, more preferably at least 85% by volume and still more preferably at least 95% by volume of the separated hydrocarbon is hydrocarbon mixture.

The recovered, and separated, hydrocarbon mixture is preferably transported to a fractionating column or fractionator. A conventional fractionator, well known in the petroleum industry, may be used. Thus a preferred method of the invention comprises fractionating the recovered hydrocarbon mixture prior to the deasphalting. Preferably separation is carried out prior to fractionating. Preferably at least one lighter fraction, e.g. comprising naphtha, kerosene, light gas oils and heavy gas oils, is removed from the mobilised hydrocarbon mixture during the fractionation. Preferably a heavier fraction and at least one lighter fraction is produced during fractionation. Preferably an even lighter fraction, e.g. comprising $C_{3-6}$ hydrocarbons, is also removed from the hydrocarbon mixture, or produced, during fractionation.

A preferred method of the present invention comprises:

(i) injecting steam into said formation to mobilise said hydrocarbon mixture
(ii) recovering said mobilised hydrocarbon mixture, wherein said mobilised hydrocarbon mixture comprises water and hydrocarbon;
(iii) separating said hydrocarbon mixture to produce separated water and separated hydrocarbon, wherein a diluent is added to said mobilised hydrocarbon mixture prior to said separation;
(iv) fractionating said separated hydrocarbon to produce at least one heavier fraction and at least one lighter fraction;
(v) deasphalting said hevaier fraction to produce a deasphalted hydrocarbon and asphaltenes;
(vi) combusting said asphaltenes in an oxycombustion process to generate steam and/or energy and $CO_2$; and
(vii) injecting said steam produced in step (v) into said formation and/or applying said energy produced in step (v) to generate steam and injecting said steam into said formation, wherein said method is at least partially self-sufficient in terms of steam generation and wherein at least some of said diluent comprises said lighter fraction obtained during fractionation.

Particularly preferably the at least one lighter fraction obtained by fractionation comprises a significant proportion of naphtha, e.g. at least 20% by weight of the mixture is naphtha. Preferably, the lighter hydrocarbon mixture comprises 10 to 50% wt by weight, of naphtha.

Particularly preferably the at least one lighter fraction obtained by fractionation also comprises a large proportion of middle distillate, e.g. at least 30% by weight of the mixture is kerosene, light gas oil and heavy gas oil. Preferably, the lighter hydrocarbon mixture comprises 50 to 90% by weight, of middle distillate. By "kerosene" is meant a hydrocarbon fraction having a boiling point between about 180° C. and 240° C.; by "light gas oil" is meant a hydrocarbon fraction having a boiling point between about 240° C. and 320° C., and by "heavy gas oil" is meant a hydrocarbon fraction having a boiling point between about 320° C. and 400° C.

The lighter fraction will generally contain the majority of any diluent added to the crude hydrocarbon mixture, i.e. prior to separation. This lighter fraction is used or recycled as diluent for addition to further crude hydrocarbon mixture. The diluent is added to the separator and/or to a line transporting crude hydrocarbon mixture to the separator. Additionally, as described below in more detail, this lighter fraction is preferably used in a later diluent addition step. An advantage of the method of the invention is therefore that the crude hydrocarbon mixture extracted from the formation supplies at least some of the diluent required for its processing.

In a preferred method of the present invention, an even lighter fraction is also removed from the hydrocarbon mixture during fractionation. Preferably the even lighter fraction comprises a large proportion of $C_{3-6}$ hydrocarbons, e.g. at least 50% by weight of the mixture is propane, butane, pentane and/or hexane. The upper limit on the amount of $C_{3-6}$ hydrocarbons present may be, e.g. 95% by weight.

In the method of the present invention the recovered hydrocarbon mixture is deasphalted. Preferably the hydrocarbon mixture that undergoes deasphalting is the hydrocarbon mixture from which the above-described lighter fraction (s) has been removed, i.e. the hydrocarbon mixture is the heavier fraction obtained from fractionation. Preferably deasphalting is carried out by solvent deasphalting. A conventional solvent such as propane, butane, pentane or hexane may be used. Alternatively deasphalting may be carried out using supercritical $CO_2$. In this case, the $CO_2$ used in the process is preferably $CO_2$ generated during the generation of steam and/or during oxycombustion.

In a further alternative, and preferred method of the invention, the method is at least partially self-sufficient or self-supporting in terms of solvent for deasphalting. Preferably therefore at least some of the solvent used for solvent deasphalting is obtained from the hydrocarbon mixture being processed. Preferably at least some of the solvent used in the deasphalting is the lighter fraction, e.g. comprising $C_{3-6}$ hydrocarbons such as propane, butane, pentane and/or hexane obtained by fractionation.

A range of different deasphalter units are commercially available. Units employing counter-current extraction methodology wherein the solvent (and deasphalted hydrocarbon) flow upwards against down flowing asphaltene may, for example, be used optionally in combination with packing. Alternatively deasphalting may be carried out using the ROSE process.

The deasphalting step of the method of the present invention produces deasphalted hydrocarbon and asphaltenes. Preferably the deasphalted hydrocarbon has an API in the range 12-18°. Preferably the deasphalted hydrocarbon comprises less than 5% wt, more preferably less than 3% wt, e.g. 0-2% wt asphaltenes.

The asphaltenes obtained in the deasphalting step are combusted in an oxycombustion process. Oxygen is provided from an air separation plant. Oxycombustion is preferably carried out in boilers adapted to utilise oxygen as the oxidant. The combustion generates $CO_2$ as well as steam and/or energy. The steam is injected into a formation to mobilise further hydrocarbon for recovery (e.g. in a SAGD process). The energy is used to generate steam from water for injection into a formation. This is an advantage of the process of the present invention, namely it is at least partially self-sufficient or self-supporting in terms of steam generation.

In preferred methods of the invention at least some of the $CO_2$ generated in the method is captured and stored in a subterranean formation. In preferred methods of the invention at least a portion of the $CO_2$ produced during the oxycombustion is captured and stored. In further preferred methods of the invention at least a portion of the $CO_2$ generated during steam generation is captured and stored. Preferably the $CO_2$ produced in the method of the invention is captured in a $CO_2$ purifier. The $CO_2$ purifier may be, for example, a $CO_2$ capture apparatus comprising an absorption tower and a regeneration tower. Such towers are conventional in the art. Preferably the $CO_2$-containing gas is contacted, typically in counter flow, with an aqueous absorbent in an absorber column. The gas leaving the absorber column is preferably $CO_2$ depleted and can be released to the atmosphere. The $CO_2$ preferably leaves the absorber column together with the absorbent. Typically the absorbent is subsequently regenerated in a regenerator column and returned to the absorber column. The $CO_2$ separated from the absorbent is preferably sent for storage, e.g. in a subterranean formation.

In preferred methods of the invention the deasphalted hydrocarbon is blended with diluent. In a further preferred method the deasphalted hydrocarbon is upgraded. In some preferred methods a diluent is added to the deasphalted hydrocarbon. In other preferred methods a diluent is added to upgraded hydrocarbon. Once blended with diluent, the deasphalted and/or upgraded hydrocarbon is generally referred to as syncrude.

Preferred methods of the present invention are at least partially self-sufficient or self-supporting in terms of diluent. As described above, the diluent is preferably obtained from the hydrocarbon mixture being processed. In this sense the method of the present invention is preferably at least partially self-supporting in terms of diluent. This reduces or eliminates the need to transport and store external diluent for this purpose.

The diluent added to the deasphalted and/or upgraded hydrocarbon preferably comprises a lighter fraction, e.g. comprising naphtha, kerosene, light gas oils and/or heavy gas oils, obtained during fractionation. Thus particularly preferred methods of the invention comprise:

(i) injecting steam into said formation to mobilise said hydrocarbon mixture
(ii) recovering said mobilised hydrocarbon mixture, wherein said mobilised hydrocarbon mixture comprises water and hydrocarbon;
(iii) separating said hydrocarbon mixture to produce separated water and separated hydrocarbon, wherein a diluent is added to said mobilised hydrocarbon mixture prior to said separation;
(iv) fractionating said separated hydrocarbon to produce at least one heavier fraction and at least one lighter fraction;
(v) deasphalting said hevaier fraction to produce a deasphalted hydrocarbon and asphaltenes;
(vi) combusting said asphaltenes in an oxycombustion process to generate steam and/or energy and $CO_2$;
(vii) optionally upgrading said deasphalted hydrocarbon to produce upgraded hydrocarbon;
(viii) adding diluent to said deasphalted hydrocarbon and/or said upgraded hydrocarbon;
(ix) injecting said steam produced in step (v) into said formation and/or applying said energy produced in step (v) to generate steam and injecting said steam into said formation, wherein said method is at least partially self-sufficient in terms of steam generation and wherein at least some of said diluent comprises said lighter fraction obtained during fractionation.

The mixing of the diluent and the hydrocarbon mixture may be carried out using conventional equipment, e.g. a diluent addition tank. The mixing or blending may, for example, be achieved by stirring or agitation in a vessel, using jet mixers or mixer nozzles, line mixing or pump mixing. Preferably the mixing step yields a homogenous mixture.

Other preferred methods of the invention comprise upgrading the deasphalted hydrocarbon. As used herein the term "upgrading" refers to a process wherein the hydrocarbon mixture is altered to have more desirable properties, e.g. to providing lighter, synthetic crude oils from heavier hydrocarbon mixtures by chemical processes. The term upgrading therefore encompasses processes wherein the average molecular weight of the hydrocarbons present in the upgraded hydrocarbon mixture is lower than the average molecular weight of the hydrocarbons in the heavy hydrocarbon starting mixture. The term also encompasses processes wherein the hydrocarbon mixture is stabilised. In such processes, the level of unsaturation in the hydrocarbon mixture is reduced.

In preferred methods of the invention the upgrading is carried out using a thermal process. Any thermal process known in the art may be used. Preferred thermal processes include delayed coking, visbreaking, hydrocracking (e.g. fixed bed, ebullated bed or slurry hydrocracking) and hydrotreating (e.g. distillate hydrotreating). Particularly preferably the upgrading is carried out by hydrocracking or visbreaking.

Hydrocracking is a process wherein the hydrocarbon mixture is heated in the presence of an elevated partial pressure of hydrogen. The hydrogen functions to remove double bonds from the hydrocarbons present in the mixture as well as to remove sulphur and nitrogen atoms. It is a well known process in the field of petroleum chemistry and a wide range of equipment for carrying out the process is commercially available. When hydrocracking is used as the upgrading method in the process of the invention it is typically carried out a temperature of 300-450° C., more preferably 350-420° C. The pressure used is preferably 100-200 bar, more preferably 150-180 bar. A catalyst is typically employed in the process. A typical residence time may be 0.5 to 2 hours, e.g. 1 hour to 1.5 hours.

Visbreaking may be carried out using a conventional soaker visbreaking process. In a typical process the first portion of heavy hydrocarbon mixture is heated, e.g. to a temperature of 400-500° C. The heated heavy hydrocarbon is then transferred to a soaker vessel. The residence time in the vessel is preferably 5 to 30 minutes.

Upgrading may be carried out in a single step or in multiple (e.g. 2 or 3) steps. If a single step is used, the upgrading process is preferably thermal cracking or visbreaking. If multiple steps are used, the upgrading process preferably comprises thermal cracking and visbreaking. Particularly preferably the upgrading comprises thermal cracking and visbreaking.

The hydrocarbon mixture produced by the method of the invention is preferably transportable. More preferably the hydrocarbon mixture is pumpable, e.g. it has a sufficiently low density and viscosity (e.g. at ambient conditions) to flow along a pipeline. The hydrocarbon mixture produced by the method of the invention preferably has an API gravity of at least about 5 degrees higher than that of the crude hydrocarbon mixture, e.g. an API gravity of at least about 8, 12, 15 or 18 degrees higher. In a preferred embodiment, the hydrocarbon mixture has an API gravity of greater than 20 degrees, e.g. greater than 25 or 30 degrees, e.g. up to about 35 degrees. Preferred hydrocarbon products have an API gravity of about 15-30 degrees, more preferably about 20-25 degrees.

In preferred processes of the present invention the hydrocarbon mixture produced by the method of the invention preferably has a viscosity of less than 500 cST at 7° C., more preferably less than 400 cST at 7° C., still more preferably less than 350 cST at 7° C. Preferably the viscosity of the hydrocarbon mixture is in the range 100-500 cST at 7° C., more preferably 200-400 cST at 7° C., e.g. about 300-350 cST at 7° C.

The present invention also relates to a system for carrying out the method of the invention hereinbefore described. Preferred features of the method hereinbefore described are also preferred features of the system. The well arrangement present in a preferred system is a SAGD well pair.

The systems of the present invention comprise a well arrangement, a separator, a fractionator, a deasphalter unit, an oxycombustion unit, a means for transporting steam and a means for transporting at least one lighter fraction produced in the fractionator.

The deasphalter unit is fluidly connected to the fractionator and has an outlet for deasphalted hydrocarbon and an outlet for asphaltenes as well as an oxycombustion unit fluidly connected to the outlet for asphaltenes of the deasphalter and having an outlet for steam and/or a means to store energy for conversion of water into steam. The system also comprises a means for transporting steam generated by the oxycombustion unit, either directly or indirectly, to the well arrangement. As used herein the term "fluidly connected" refers to means to transport a fluid from a first unit to a second unit, optionally via one or more intervening units. The fluid connection may therefore be direct or indirect.

The systems of the invention further comprise a separator for separating the recovered hydrocarbon into separated water and separated hydrocarbon, the separator being in between the well arrangement and the fractionator and having an inlet fluidly connected to the well arrangement, an outlet for separated hydrocarbon fluidly connected to the fractionator and an outlet for separated water. Preferably the outlet for separated water is fluidly connected to a water treatment unit for cleaning water for steam generation. Preferably the water treatment unit is fluidly connected to the steam generator and said generator has an outlet fluidly connected to the well arrangement.

The systems further comprise a fractionator, the fractionator being in between the separator and the deasphalter unit, and having an inlet for separated hydrocarbon fluidly connected to the separator, an outlet for a heavier fraction fluidly connected to the deasphalter unit and an outlet for at least one lighter fraction. The fractionator further comprises a means for transporting the at least one lighter fraction from the fractionator to the separator and/or to the line transporting recovered hydrocarbon mixture to the separator. Further preferred systems comprise a means for transporting an even lighter fraction from the fractionator to the deasphalter unit.

Yet further preferred systems comprise a diluent addition tank having an inlet fluidly connected to the deasphalter unit, an inlet for diluent and an outlet for syncrude. Preferably the system comprises a means for transporting the at least one lighter fraction from the fractionator to the inlet of the diluent addition tank. A particularly preferred system of the invention therefore comprises:

(a) a well arrangement for a steam-based method of recovering said hydrocarbon mixture comprising a production well;
(b) a separator for separating said recovered hydrocarbon mixture into separated water and separated hydrocarbon, said separator having an inlet fluidly connected to said well arrangement, an outlet for separated hydrocarbon fluidly connected to said fractionator and an outlet for separated water;
(c) a fractionator having an inlet for separated hydrocarbon connected to said separator, an outlet for a heavier fraction fluidly connected to said deasphalter unit and an outlet for at least one lighter fraction;
(d) a deasphalter unit fluidly connected to said fractionator and having an outlet for deasphalted hydrocarbon and an outlet for asphaltenes;
(e) a diluent addition tank having an inlet fluidly connected to said deasphalter unit, an inlet for diluent and an outlet for syncrude;
(f) an oxycombustion unit fluidly connected to said outlet for asphaltenes of said deasphalter and have an outlet for steam and/or a means to store energy for conversion of water into steam;
(g) a means for transporting steam generated by said oxycombustion unit to said well arrangement;
(h) a means for transporting said at least one lighter fraction from said fractionator to said separator and/or to the line transporting recovered hydrocarbon mixture to said separator; and
(i) a means for transporting said at least one lighter fraction from said fractionator to the inlet of said diluent addition tank. A further preferred system comprises a means for transporting at least one lighter fraction from said fractionator to the deasphalter unit.

Still further preferred systems comprise a $CO_2$ purifier having an inlet fluidly connected to the oxycombustion unit and an outlet connected to a subterranean formation for $CO_2$ storage. Preferably the $CO_2$ purifier further comprises an inlet fluidly connected to a means for steam generation. Preferred systems further comprise a means for steam generation, e.g. steam boiler or once through steam generator.

Further preferred systems comprise a visbreaker having an inlet fluidly connected to the deasphalter unit and/or the diluent addition tank. Yet further preferred systems comprise a thermal cracker having an inlet fluidly connected to the deasphalter unit and/or the diluent addition tank.

DETAILED DESCRIPTION OF PREFERRED EMBODIMENTS

Figure 1:
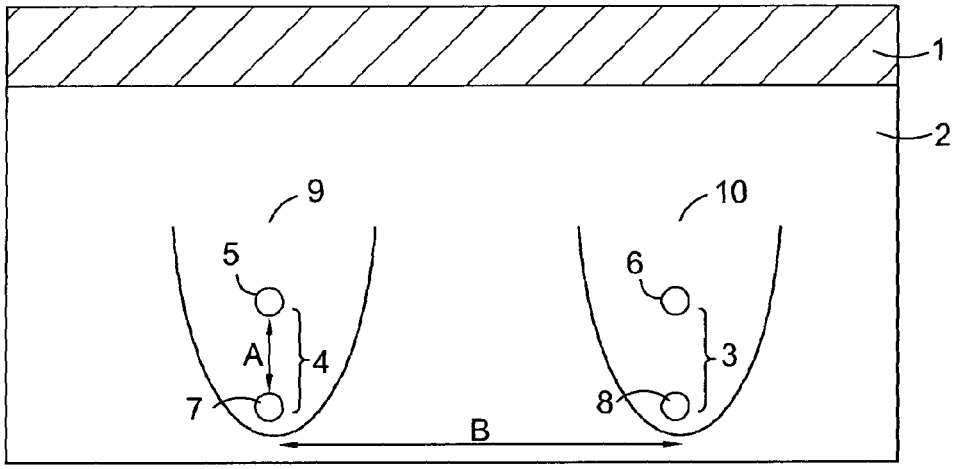
FIG. 1 is a schematic view of a cross section of an oil-bearing formation with SAGD well pairs suitable for carrying out the method of the invention.

Referring to FIG. 1 it shows a cross section of a reservoir comprising SAGD well pairs. FIG. 1 shows the reservoir shortly after SAGD is started. A covering of overburden 1 lies above the hydrocarbon-containing portion of the reservoir 2. Each SAGD well pair 3, 4 comprises an injector well 5, 6 and a producer well 7, 8. The vertical separation (arrow A) between each well pair is about 5 m. The horizontal separation (arrow B) between each well pair is about 100 m. The injector wells 5, 6 are at the same depth in the reservoir and are parallel to each other. Similarly the producer wells 7, 8 are at the same depth in the reservoir and are parallel to each other. The producer wells are preferably provided with a liner (not shown) as is conventional in the art.

In FIG. 1 steam has been injected into injector wells 5, 6 thus heated areas 9, 10 around each of the injector wells have been formed. In these areas the latent heat from the steam is transferred to the hydrocarbon and, under gravity, it drains downwards to producer wells 7, 8. From producer wells 7, 8 the mobilised hydrocarbon is pumped to the surface.

Figure 2:
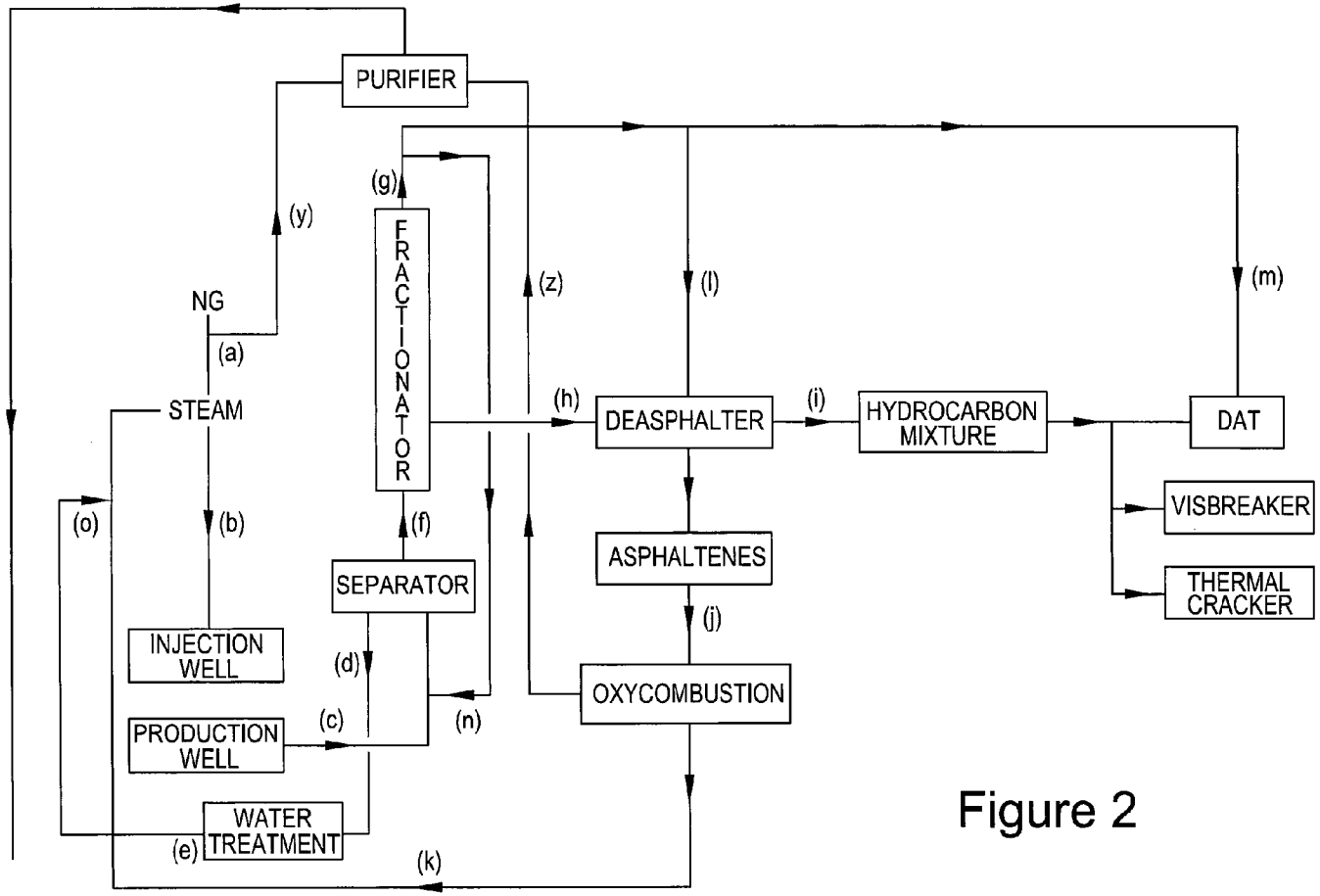
FIG. 2 is a flow diagram of a method and system of the invention showing the flow of each of steam, diluent, $CO_2$ and water.

Referring to FIG. 2 it shows the flow of each of steam, water, diluent and $CO_2$ through the method and system of the invention.

Considering first the flow of steam and water, initially steam is generated from natural gas by conventional methods (arrow a). The steam is injected via the injection wells of SAGD well pairs into a subterranean formation (arrow b) as described above in relation to FIG. 1. The steam mobilises heavy hydrocarbon present in the formation and heavy hydrocarbon is recovered at the surface from producer wells (arrow c). The mobilised hydrocarbon comprises a mixture of water and hydrocarbon and is routed to a bulk separator wherein the water and hydrocarbon are separated. Diluent is added to the mixture prior to its entry to the separator (arrow n). The separated water is collected (arrow d) and sent to a treatment facility for cleaning so it can be reused for further steam generation (arrow e). The separated hydrocarbon is transported to a fractionator (arrow f) wherein naphtha, kerosene, light gas oils and heavy gas oils are removed (arrow g). The remaining hydrocarbon mixture (i.e. heavier fraction) is transported to a deasphalting unit (arrow h) wherein solvent deasphalting takes place. The deasphalting process produces deasphalted hydrocarbon that is transported out of the deasphalter (arrow i) and asphaltenes that are transported to an oxycombustion unit (arrow j). Oxycombustion of the asphaltenes generates steam for use in hydrocarbon recovery and/or energy that is used to generate further steam (arrow k). Preferably the energy generated is used to convert the separated water from the separator into steam (arrow o). The method of the invention is advantageous because some of the energy inherently present in the hydrocarbon recovered is used to fuel the generation of steam for further hydrocarbon recovery. In this sense the method is at least partially self-supporting in terms of steam-generation.

Considering now the flow of diluent through the method, as described above, the separated hydrocarbon is transported to a fractionator wherein a lighter fraction comprising naphtha, light gas oils and heavy gas oils is removed (arrow g). The naphtha and/or middle distillate obtained is used as the diluent that is added to the mixture of hydrocarbon and water prior to its entry to the separator (arrow n). Optionally the lighter fraction may also be used as the solvent in the deasphalting process (arrow l). Moreover the naphtha, kerosene, light gas oils and heavy gas oils obtained from the fractionator is used as a diluent for the deasphalted hydrocarbon mixture (arrow m). The recycling of the naphtha, kerosene, light gas oil and/or heavy gas oil from the heavy hydrocarbon for these purposes is highly advantageous. It avoids the need to transport and store an external diluent specifically for these purposes. Additionally because the diluent is generated from the hydrocarbon mixture into which it is being reintroduced, it is unlikely to cause any instability problems. A further advantage of the method is the compounds present in the heavy hydrocarbon are used in its processing. As above therefore, the method is at least partially self-supporting in terms of production of solvent for solvent deasphalting and/or diluent for addition to crude hydrocarbon mixture and optionally production of syncrude.

Considering now the flow of $CO_2$ through the method, $CO_2$ is generated at several points, namely during conversion of natural gas to steam, during oxycombustion of asphaltenes and, in some cases, during upgrading of the deasphalted hydrocarbon mixture. The $CO_2$ is captured and transported (arrows y, z) to a purifier where it is cleaned. The $CO_2$ is then pressurised, condensed and pumped to available $CO_2$ subterranean formation sites (arrow x). A further advantage of the method of the invention is that less $CO_2$ is released to the atmosphere than in traditional SAGD based processes.

Figure 3:
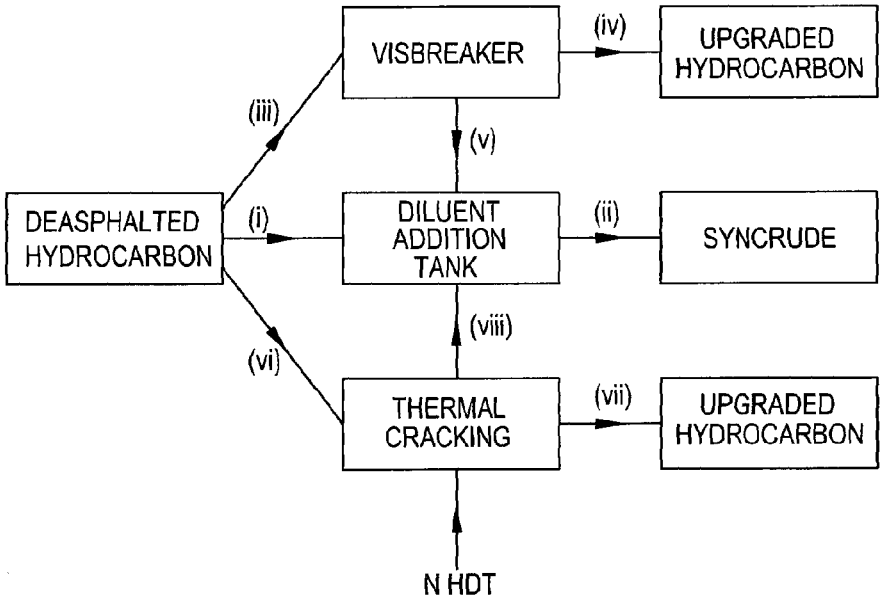
FIG. 3 is a flow diagram of preferred downstream processing methods for the deasphalted hydrocarbon obtained during the method of the invention.

Referring to FIG. 3, it shows a flow diagram of preferred processing methods for the deasphalted hydrocarbon produced in the method of the invention. In one preferred method the deasphalted hydrocarbon is transported to a diluent addition tank (arrow (i)) wherein the hydrocarbon mixture is blended with diluent to produce syncrude (arrow (ii)). As discussed above, the diluent added to the hydrocarbon is preferably obtained from the fractionation carried out on the crude hydrocarbon mixture. In another preferred method the deasphalted hydrocarbon is upgraded in a thermal visbreaker (arrow (iii)). In a typical process the hydrocarbon mixture is heated to 400-500° C. and then transferred to a soaking vessel to "soak" for 5 to 30 minutes. The resulting upgraded hydrocarbon may be transportable (arrow (iv)) or may be blended with diluent in the diluent addition tank (arrow (v)) to generate syncrude (arrow (ii)). In a further preferred method the deasphalted hydrocarbon is upgraded in a thermal cracker (arrow (vi)). In a typical process the deasphalted hydrocarbon mixture is heated to a temperature of 300-450° C. in the presence of an elevated partial pressure of hydrogen of 100-200 bar and in the presence of a catalyst. A typical residence time may be 0.5 to 2 hours. The resulting upgraded hydrocarbon may be transportable (arrow (vii)) or may be blended with diluent to the diluent addition tank (arrow (viii)) to generate syncrude (arrow (ii)).

The method of the present invention has several advantages including:

Oxycombustion of asphaltenes obtained from the hydrocarbon mixture generates steam and/or energy for generation of steam for use in further hydrocarbon recovery Water for steam generation can be recycled by separating out and cleaning the water produced from the hydrocarbon formation along with the hydrocarbon mixture Fractionation of the hydrocarbon mixture produces a lighter fraction, e.g. naphtha and/or light gas oils, that can be used as solvent in the deasphalting process and/or as diluent for the deasphalted hydrocarbon, e.g. in the generation of syncrude Fractionation of the hydrocarbon mixture produces a lighter fraction, e.g. naphtha and/or light gas oils, that can be used as diluent for the crude heavy hydrocarbon mixture to improve the separation process.

Little, if any, $CO_2$ is released to the atmosphere. Instead the $CO_2$ is captured and stored in a formation.

The method of the invention is therefore at least partially self-supporting. The hydrocarbon mixture recovered from the subterranean formation provides solvent for deasphalting, diluent for the generation of syncrude as well as at least some of the water and steam and/or energy required for steam generation for the hydrocarbon recovery.

The invention claimed is:

1. A steam based method of recovering and processing a hydrocarbon mixture from a subterranean formation, comprising:

(i) injecting steam into said formation to mobilise said hydrocarbon mixture;

(ii) recovering said mobilised hydrocarbon mixture, wherein said mobilised hydrocarbon mixture comprises water and hydrocarbon;

(iii) separating said hydrocarbon mixture to produce separated water and separated hydrocarbon, wherein a first diluent is added to said mobilised hydrocarbon mixture prior to said separation;

(iv) fractionating said separated hydrocarbon to produce at least one heavier fraction and at least one lighter fraction;

(v) deasphalting said heavier fraction to produce a deasphalted hydrocarbon and asphaltenes;

(vi) adding a second diluent to said deasphalted hydrocarbon;

(vii) combusting said asphaltenes in an oxycombustion process to generate steam and $CO_2$; and (viii) injecting said steam produced in step (vii) into said formation, wherein said method is at least partially self-sufficient in terms of steam generation, and wherein at least some of said first and second diluent for addition to said mobilised hydrocarbon mixture and to said deasphalted hydrocarbon comprises said lighter fraction obtained directly during fractionation.

2. The method of claim 1, wherein said lighter fraction comprises naphtha, kerosene and light gas oils.

3. The method of claim 1, wherein said deasphalting is solvent deasphalting.

4. The method of claim 3, wherein said method is at least partially self-sufficient in terms of solvent for deasphalting.

5. The method of claim 4, wherein the solvent used in said deasphalting is said lighter fraction obtained directly during fractionating.

6. The method of claim 5, wherein the lighter fraction comprises propane, butane, pentane, hexane, or mixtures thereof.

7. The method of claim 1, wherein the solvent used in said deasphalting is $CO_2$ generated during the generation of steam or during oxycombustion.

8. The method of claim 1, wherein at least a portion of the $CO_2$ produced during said oxycombustion is captured and stored.

9. The method of claim 1, wherein at least a portion of the $CO_2$ generated during steam generation is captured and stored.

10. The method of claim 1, further comprising upgrading said deasphalted hydrocarbon.

11. The method of claim 10, wherein said upgrading comprises thermal visbreaking.

12. The method of claim 10, wherein said upgrading comprises thermal cracking.

13. The method of claim 10, comprising adding a third diluent to said upgraded hydrocarbon.

14. The method of claim 13, wherein said method is at least partially self-sufficient in terms of said third diluent.

15. The method of claim 13, wherein said third diluent comprises a lighter fraction obtained directly during fractionating.

16. The method of claim 15, wherein said lighter fraction comprises naphtha, kerosene, light gas oils, or mixtures thereof.

17. The method of claim 1, comprising:

(i) injecting steam into said formation to mobilise said hydrocarbon mixture;

(ii) recovering said mobilised hydrocarbon mixture, wherein said mobilised hydrocarbon mixture comprises water and hydrocarbon;

(iii) separating said hydrocarbon mixture to produce separated water and separated hydrocarbon, wherein said first diluent is added to said mobilised hydrocarbon mixture prior to said separation;

(iv) fractionating said separated hydrocarbon to produce at least one heavier fraction and at least one lighter fraction;

(v) deasphalting said heavier fraction to produce a deasphalted hydrocarbon and asphaltenes;

(vi) adding said second diluent to said deasphalted hydrocarbon;

(vii) combusting said asphaltenes in an oxycombustion process to generate steam and $CO_2$;

(viii) upgrading said deasphalted hydrocarbon to produce upgraded hydrocarbon;

(ix) adding a third diluent to said upgraded hydrocarbon; and (x) injecting said steam produced in step (vii) into said formation, wherein said method is at least partially self-sufficient in terms of steam generation, and wherein at least some of said first, second and third diluent for addition to said mobilized hydrocarbon mixture, said deasphalted hydrocarbon and said upgraded hydrocarbon comprises said lighter fraction obtained directly during fractionation.

18. The method of claim 17, wherein said oxycombustion process in step (vii) generates energy, wherein said energy is applied to generate steam, and wherein said steam is injected into said formation.

19. The method of claim 1, wherein said separated water is cleaned and recycled for steam generation.

20. The method of claim 19, wherein said separated water is converted to steam using energy generated in said oxycombustion.

21. The method of claim 1, which is at least partially self-sufficient in terms of water for steam generation.

22. The method of claim 1, wherein said oxycombustion process in step (vii) generates energy, wherein said energy is applied to generate steam, and wherein said steam is injected into said formation.

23. A system for recovering and processing a hydrocarbon mixture, comprising:

(a) a well arrangement for recovering said hydrocarbon mixture comprising a production well;

(b) a separator for separating said recovered hydrocarbon mixture into separated water and separated hydrocarbon, said separator having an inlet fluidly connected to said well arrangement, an outlet for separated hydrocarbon fluidly connected to said fractionator and an outlet for separated water;

(c) a fractionator having an inlet for separated hydrocarbon connected to said separator, an outlet for a heavier fraction fluidly connected to said deasphalter unit and an outlet for at least one lighter fraction;

(d) a deasphalter unit fluidly connected to said fractionator and having an outlet for deasphalted hydrocarbon and an outlet for asphaltenes;

(e) a diluent addition tank having an inlet fluidly connected to said deasphalter unit, an inlet for diluent and an outlet for syncrude;

(f) an oxycombustion unit fluidly connected to said outlet for asphaltenes of said deasphalter and having an outlet for steam;

(g) a first line for transporting steam generated by said oxycombustion unit to said well arrangement;

(h) a second line for transporting said at least one lighter fraction from said fractionator directly to said separator or to the line transporting recovered hydrocarbon mixture to said separator; and (i) a third line for transporting said at least one lighter fraction from said fractionator directly to the inlet of said diluent addition tank.

24. The system of claim 23, wherein said outlet for separated water is fluidly connected to a water treatment unit for cleaning water for steam generation.

25. The system of claim 23, further comprising a fourth line for transporting at least one lighter fraction from said fractionator directly to said deasphalter unit.

26. The system of claim 23, further comprising a $CO_2$ purifier having an inlet fluidly connected to said oxycombustion unit and an outlet connected to a subterranean formation for $CO_2$ storage.

27. The system of claim 26, wherein said $CO_2$ purifier further comprises an inlet fluidly connected to a steam generator.

28. The system of claim 23, further comprising a visbreaker having an inlet fluidly connected to said deasphalter unit or said diluent addition tank.

29. The system of claim 23, further comprising a thermal cracker having an inlet fluidly connected to said deasphalter unit or said diluent addition tank.

* * * * *